United States Patent [19]

Hunt et al.

[11] Patent Number: 4,935,968

[45] Date of Patent: Jun. 26, 1990

[54] PATIENT SUPPORT APPLIANCES

[75] Inventors: Kenneth W. Hunt, Wimborne; Peter G. Gore, Poole; David Warren, Swanage, all of England; Leonard Higgs, Signal Hill, Calif.

[73] Assignee: Mediscus Products, Ltd., Wareham, United Kingdom

[21] Appl. No.: 2,766

[22] PCT Filed: May 9, 1986

[86] PCT No.: PCT/GB86/00250

§ 371 Date: Jan. 21, 1987

§ 102(e) Date: Jan. 21, 1987

[87] PCT Pub. No.: WO86/06624

PCT Pub. Date: Nov. 20, 1986

[30] Foreign Application Priority Data

| | | | |
|---|---|---|---|
| May 10, 1985 | [GB] | United Kingdom | 8511903 |
| Jul. 10, 1985 | [GB] | United Kingdom | 8517497 |
| Sep. 24, 1985 | [GB] | United Kingdom | 8523577 |

[51] Int. Cl.[5] ..... A61G 7/00; A47C 27/08

[52] U.S. Cl. ..... 5/453; 5/455

[58] Field of Search ..... 5/453, 455, 469, 423, 5/449, 456

[56] References Cited

U.S. PATENT DOCUMENTS

| | | | |
|---|---|---|---|
| 3,822,425 | 7/1974 | Scalbs | 5/469 |
| 4,099,276 | 7/1978 | Hunt et al. | 5/455 |
| 4,488,322 | 12/1984 | Hunt et al. | 5/453 |
| 4,525,885 | 7/1985 | Hunt et al. | 5/453 |
| 4,638,519 | 1/1987 | Hess | 5/469 |
| 4,686,722 | 8/1987 | Swart | 5/455 |

FOREIGN PATENT DOCUMENTS

| | | | |
|---|---|---|---|
| 0034954 | 2/1981 | European Pat. Off. . | |
| 1273342 | 5/1972 | United Kingdom | 5/455 |
| 1474018 | 5/1977 | United Kingdom . | |
| 1545806 | 5/1979 | United Kingdom | 5/455 |
| 1601808 | 11/1981 | United Kingdom . | |
| 2077859B | 12/1981 | United Kingdom . | |
| 2070426B | 11/1984 | United Kingdom . | |
| 2141333 | 12/1984 | United Kingdom . | |

OTHER PUBLICATIONS

National Research Council of Canada, Medical Instrumentation, vol. 3, No. 1, Jun. 1976 "*The NRC Hospital Air Bed*".

*Primary Examiner*—Alexander Grosz

*Attorney, Agent, or Firm*—Wolf, Greenfield & Sacks

[57] ABSTRACT

A patient support appliance is provided of the kind formed from a plurality of inflatable air sacs, mounted on an articulating base and extending transversely of the base so as to provide, when inflated, a surface for supporting a person thereon. The base is divided into sections lengthwise of the appliance and the air sacs arranged in groups corresponding to said sections. An airblower for supplying air to the sacs is suspended from said base or mounted on a supporting frame. Air from the blower is fed to the appliance by a main air supplying conduit via a distribution chamber and individual air supply tubes lead from the distribution chamber to the groups of sacs. Pressure regulating valves are provided to regulate individually the pressure of air in the air supply tubes so that the pressure of air in each group can be regulated independently of the others. Means are provided for exhausting air rapidly from the distribution chamber, e.g. by opening a plate covering a hole in the chamber, whereby the sacs may be quickly deflated, e.g. for an emergency or other nursing procedures.

16 Claims, 9 Drawing Sheets

PATIENT SUPPORT APPLIANCES

This invention relates to support appliances of the kind in which a patient is supported on a plurality of contiguous inflated air sacs.

In British patent application No. 2,141,333 A, there is described a bed of the above kind in which one feature of its construction is that the elongated inflatable air sacs are arranged on flat obstruction free sections which are hingedly joined together. The bed described in the above-mentioned co-pending patent application may be mounted upon a standard hospital bed or constructed as part of a purpose built integral low air loss bed unit of the kind described in British patent No. 1,474,018. The present invention relates to low air loss appliances of both kinds, i.e. those having their own custom-built trolley frames as well as appliances which can be fitted to a standard hospital bed frame such as a 'Kings Fund' bed or beds such as those manufactured by Hill-Rom or Joerns.

In the appliances specifically described in the above prior specification air is supplied to the sacs on the bed via individual conduits from a blower unit remote from the bed, the blower unit including pressure regulating valves so that the pressure of air supplied to different sections of the bed is controlled at the remote blower unit. While this arrangement has some technical and clinical advantages, e.g. it is easier to maintain high safety standards and reduce blower noise perceived by the user of the bed, the use of a separately housed blower, heater and control equipment and the need to connect the bed and blower unit with trailing hoses can be a disadvantage where space is limited.

According to one aspect of the present invention there is provided a patient support appliance having a base which provides a flat, obstruction free surface and a plurality of elongated inflatable air sacs mounted on said surface and extending transversely of the appliance so as to provide a surface for supporting a person thereon, an air blower for supplying pressurised air to the sacs which is mounted beneath said base or adjacent thereto, a main air supply conduit for feeding air from the blower to a distribution chamber and individual air supply conduits leading from said distribution chamber to said sacs, pressure regulating means being included to regulate the pressure of air supplied to the sacs from the distribution chamber, whereby the pressure in individual sacs or groups of sacs can be adjusted so that the area of contact between a person supported on the sacs can be maximised.

The blower unit is preferably housed within the physical confines of the bed or its supporting frame, normally beneath the base and attached to the base or on a supporting frame.

There are various possible locations for the blower. If the bed is of the integral type described in British Patent No. 1,474,018, the blower is conveniently mounted on the trolley frame, while the distribution chamber and control valves may be mounted on the underside of the attitude frame. For example, the distribution housing and control unit may be mounted at the foot end of the bed, in a position where manual controls for the pressures in individual bed sections are readily accessible. The distribution housing is conveniently connected to the blower output by a large diameter main flexible supply conduit. However, in certain circumstances, e.g. where the dimensions of the space available make it more convenient, a pair of blowers may be mounted on the trolley frame (preferably in a common housing) and the outputs from these blowers fed to the distribution chamber via separate large diameter conduits. In the case where a pair of blowers are employed, the blower may feed a pair of supply conduits or a single supply conduit via a suitable manifold. However, non-return valves are desirably interposed in the supply conduits to prevent feed back of air from one blower to the other.

If the bed employs air operated bellows for contouring the patient supporting surface, e.g. as in U.K. Patent No. 1,474,018, an auxiliary air pump may be provided to supply air to the bellows. Since the bellows, in contrast to the air sacs, do not require a large continuous air flow, a small capacity air pump can be used which supplies a relatively small volume of air.

Alternatively, the blower may also be suspended from the underside of the base or attitude frame, preferably as close as possible to the axis about which the attitude frame pivots on the trolley frame. With this arrangement, more space is made available beneath the bed and this facilitates use of ancillary equipment such as a patient lift for assisting placement of patients on the bed.

In the use of support appliances of the kind described in U.K. Patent Specification No. 2,141,333, the location of the blower will depend upon the type of support structure used to provide a support for the appliance. Most standard hospital beds will include a frame work on which the blower unit can be mounted. In some environments, it may be satisfactory to place the blower within the overall confines of the support structure without actually fixing it to the support structure. Alternatively, the blower may be suspended from the base of the support appliance provided that it does not prevent the appliance being fitted to the desired hospital bed or other support structure.

Preferably, the distribution chamber in support appliances of the kind described in our U.K. Patent Specification No. 2,141,333, takes the form of a tubular member extending lengthwise of the appliance. The distribution chamber may also be in a tubular form in the integral type of bed as described e.g. in U.K. Patent No. 1,474,018.

The tubular chamber may be fed with the air at blower output pressure via a main supply conduit which is connected to the tubular chamber at one end of the appliance or via a connector in the region of the seat section. In one preferred form, the distribution chamber comprises a tube of rectangular, oval or flattened oval cross section, extending beneath the flat, obstruction free base surface of the appliance sections. Where the appliance sections are articulated, the tubular chamber consists of a number of tubular portions which are joined by flexible connectors in the areas of the hinges. Air is supplied to individual groups of sacs by individual hoses which are connected to the tubular distribution chamber at appropriate intervals along the appliance, normally one hose for each group of sacs.

By feeding the air supply to the bed in a large diameter supply conduit to a point close to the groups of air sacs and supplying individual groups of sacs in the bed from individual branch conduits via pressure regulating valves located in the vicinity of the sacs there are reduced pressure losses between the blower unit and the groups of sacs. Also, this arrangement reduces the complexity and number of the supply hoses and enables the construction of the bed to be simplified.

According to a further aspect of the invention there is provided a patient support appliance which comprises a plurality of contiguous elongated inflatable air sacs extending transversely of the appliance so as to provide a patient support surface, said air sacs being mounted on at least three mutually articulated sections, each corresponding approximately to the upper part of the body, the seat and the legs of the patient, said sacs being divided into a plurality of groups lengthwise of the bed, an individual supply conduit for each group of sacs, each of which is connected to a common main supply conduit leading from a source of pressurised air to said sections and pressure regulating means located in said sections for regulating the individual pressures supplied to the groups of sacs.

In a preferred embodiment of this aspect of the invention the common supply conduit is connected to a tubular member or trunking which extends through the sections of the bed. The connection may be made through the seat section or through one of the end sections. From the tubular member or trunking, branch connections may be made to feed the individual groups of sacs. A pressure regulating valve may be located at one end of the branch connection or conduit or at some point along its length. Preferably, the branch conduits each feed a header chamber for supplying a respective group of sacs. In the vicinity of hinges, the trunking or tubular members may be joined with one or more flexible connectors. One advantage of this type of air supply system is that when assembling or disassembling the sections, e.g. for transport, it is comparatively easy to connect the tubular members or trunking (which is retained within the sections) by connecting and disconnecting the flexible connectors at the hinges. In contrast, appliances in which the air is fed through the sections to the groups of sacs at individually regulated pressures (e.g. as in U.K. Patent Specification No. 2,141,333) require the individual supply hoses to be removed and re-threaded through the sections when the appliance is disassembled or assembled.

In further development applicable to all embodiments of this invention, the space occupied by a blower and heater unit is substantially reduced by incorporating the heater within the blower. It has been found surprisingly that a heater can be readily incorporated within a centrifugal blower by attaching a heater element to the diaphragm of the blower or to one of the stator blades or alternatively to the periphery of the blower housing. By incorporating the blower and the heater within the same casing the total space occupied by the blower and heater can be substantially reduced.

A centrifugal fan has the advantage that it is able to deliver large quantities of air at a relatively constant, though low, pressure. This provides an ideal type of air supply since the beds of the present invention do not require an air supply at a pressure significantly in excess of 40 millimeters of mercury but require an air flow of at least about 30 cubic feet per minute in order to sweep away the perspiration and other fluids which are carried into the air sacs and to convey heat to the bed.

Further features and advantages of the present invention will become further apparent from the various embodiments of support appliances and parts thereof constructed in accordance with this invention and which are shown in the accompanying drawings in which:-

Figure 1:
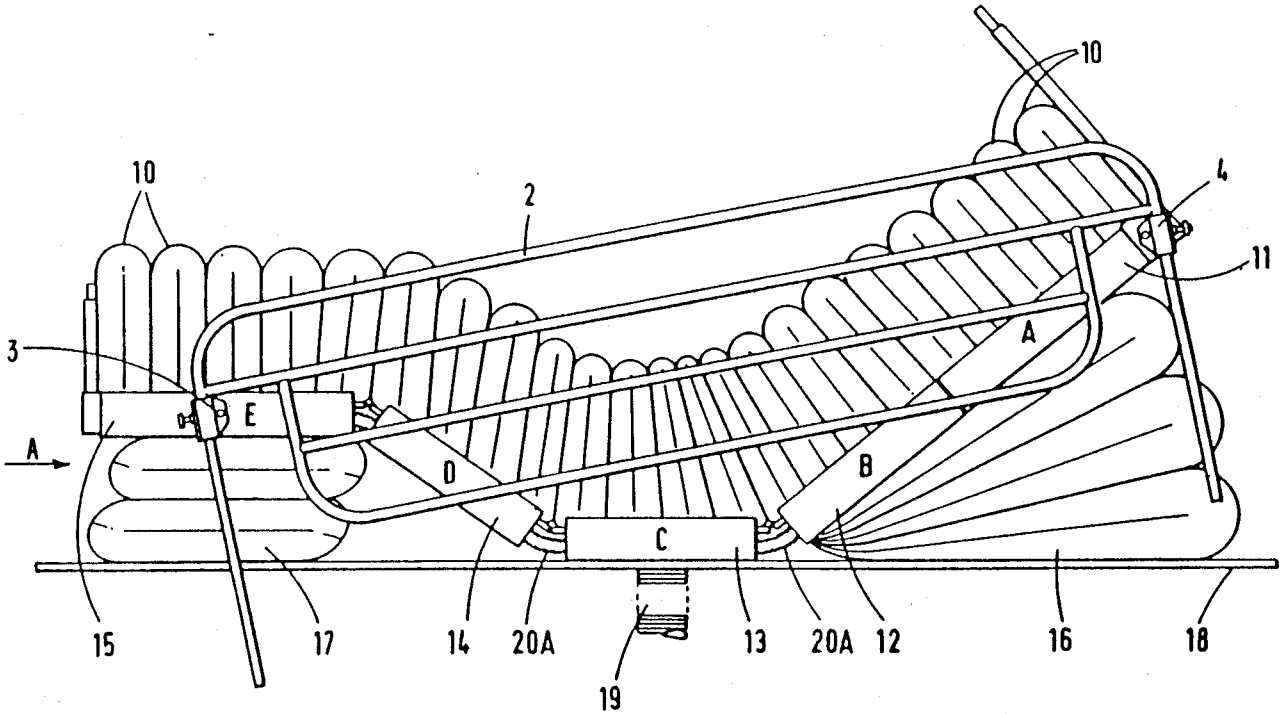
FIG. 1 is a side elevation of a support appliance in accordance with the invention.
Figure 2:
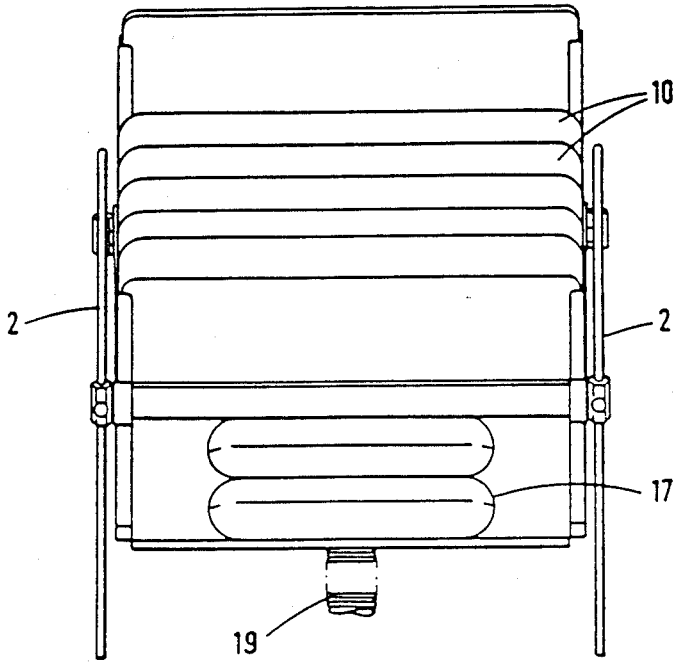
FIG. 2 is an end elevation looking in the direction of the arrow A in FIG. 1.

Referring to FIGS. 1 to 6 of the accompanying drawings, the general principle of construction of the appliances shown in these embodiments is similar to that described in our above British published application No. 2,141,333. As in our earlier application a patient supporting surface is formed by a plurality of air sacs 10 which are arranged to extend transversely across the bed. Air sacs 10 may be grouped in groups of 4 to 5 sacs labelled A to E, the air in each group of sacs being capable of being pressurised to different pressures so that the patient is subjected to minimum skin contact pressure over the overall area of his body. The pressure applied to the patient's skin should be less than that which would begin to close capillary veins so that pressure sores are avoided. As can be seen in FIG. 1 the groups of air sacs A to E are associated with housings 11, 12, 13, 14 and 15, which constitute a base. These housings are articulatedly connected together except for housings 11 and 12 which are rigidly joined. Housings 11 and 12 are intended for supporting the head and thorax of the patient while the housings 13, 14 and 15 serve for supporting the buttocks, thigh and lower legs and feet of the patient, respectively. The bed can be contoured to any desired shape by inflating or deflating the bellows 16 and 17 which will raise or lower housings 11 and 12 or 15 respectively by the action against a reaction board or support structure 18. Housing 13 (group C) is anchored to the board 18. Extendible linkages may be provided between the board 18 and the housings 15 and 11 and 12 to give lateral stability to the sections as they are raised. The board 18 may be formed in separate sections which are hinged together for ease of packing and transport. Side frames 2 are pivotally connected at brackets 3 and 4 to housings 15 and 11 respectively. If the appliance is intended to be used on a standard hospital bed which has articulated sections, the bellows 16 and 17 and the board 18 may be dispensed with and the housings 11 to 15 fitted to the appropriate sections of the standard hospital bed. Obviously, it may be necessary to adjust the dimensions of the housings to correspond with those of the hospital bed. Also, some modification of the position and type of hinges will be necessary and this may involve dispensing with the existing hinges between the housings and between the sections on the bed. Where the appliance is fitted to a standard hospital bed which is already provided with actuators for contouring the sections A to E, the head and feet bellows may not be necessary.

Figure 3:
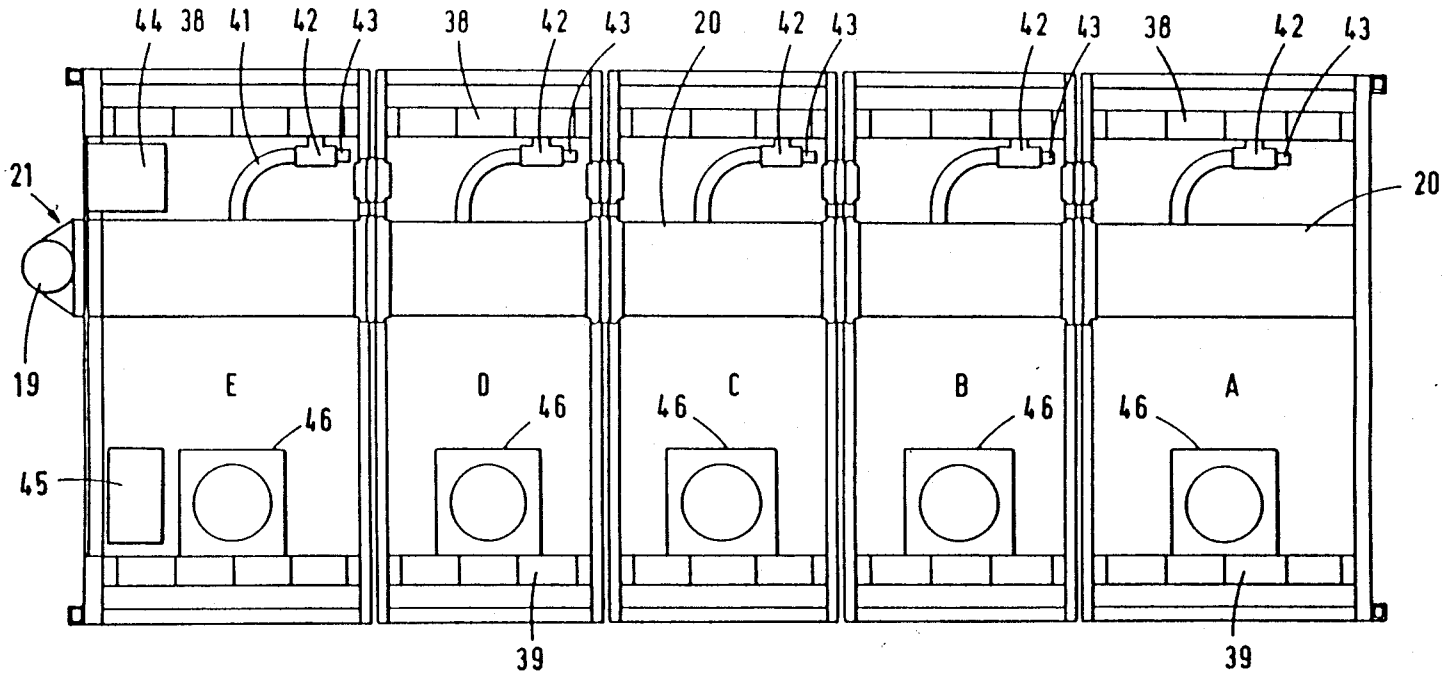
FIG. 3 is a plan view of a modified appliance in accordance with the invention with the air sacs and the top panels of the housing removed.

An air supply for feeding the air sacs 10 and the bellows 16 and 17 is conducted to the bed by a conduit 19 and distributed to the air sacs and to the bellows by a tubular member 20 (see FIG. 3) extending the length of the bed and which serves as a distribution chamber. Air is supplied to the tubular member 20 from the large diameter flexible main conduit 19. Conduit 19 may be connected to a blower unit located beneath the board 18 or attached to the frame of some supporting structure such as a hospital bed frame. Alternatively, a supply of air may be provided from a self-standing blower housing or from a remote location and fed to the hospital room or ward via permanently installed trunking. Although FIG. 1 shows the air being fed initially to the housing C from beneath the bed, air may alternatively be supplied via a connector 21 to one end of the bed as shown in FIG. 3. Preferably connector 21 is a quick-release connector, e.g. with a toggle latch, so that air can be released rapidly from the bed in an emergency or for ease of dismantling for transport.

The tube 20 extends within the depth of the sections A to E lengthwise of the bed. It is therefore normally generally rectangular or of flattened oval cross-section and at least in the portions which bridge individual housings is preferably formed from a flexible plastic tube or tubes 20A reinforced with resilient plastic ribs. The tubular portions of member 20 need not extend the entire length of each section. Preferably, the tubular portions are fabricated as elongated, rectangular boxes which are joined, via suitable fittings, at their ends to an adjacent rectangular box via one or more flexible tubes. In addition to feeding air to the air sacs via supply header chambers, the tube 20 also supplies air to the bellows at the foot and head of the bed.

Figure 5:
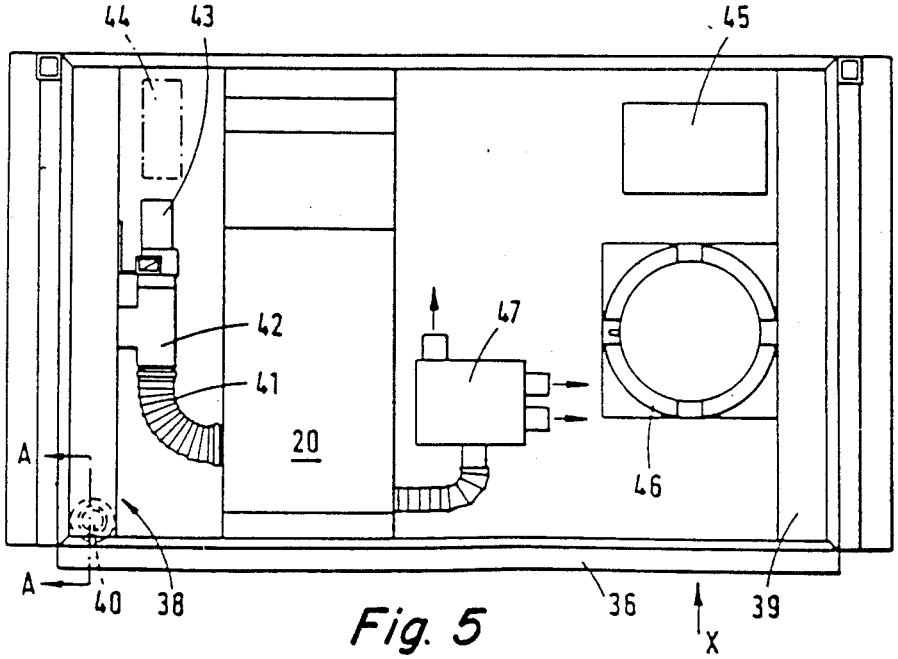
FIG. 5 is a plan view of the foot section of the appliance shown in FIG. 3 with the cover plate removed.
Figure 6:
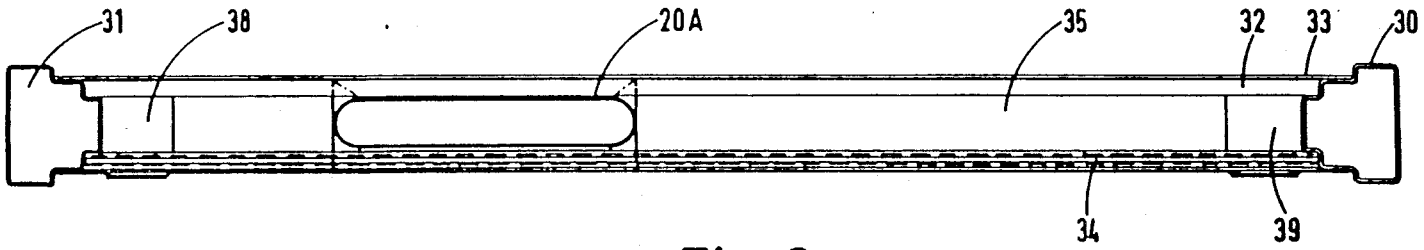
FIG. 6 is a view in the direction of the arrow X in FIG. 5.
Figure 6A:
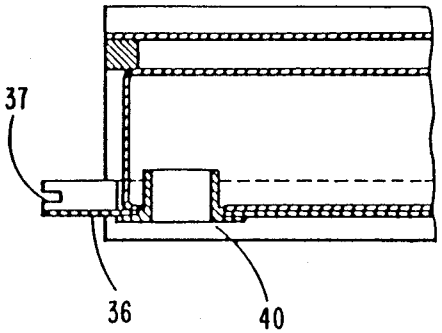
FIG. 6A is a view taken on the lines A-A in FIG. 5.

The detailed construction of the individual housings is shown in FIGS. 5, 6 and 6A and it will be seen that these consist of a pair of extruded or rolled longitudinal members 30 and 31 which are shaped to accommodate a panel 32 having a covering skin 33 which provides a flat, obstruction-free surface on which to mount the air sacs 10. FIG. 5 shows the foot section housing E but other sections are the same except that only sections A and E include bellows valves and only section E has a microprocessor board. The bottom of each housing is closed off with a board or panel 34 to provide a space within each housing 35 in which is housed the air feed tube 20A and the other components of the bed to be described later. A projecting portion 36 of the top panel 32 is formed with a slot 37 extending across the width of the housing. Slot 37 is designed to accept one half of a plastic hinge (e.g. of polypropylene) and this hinge may be shaped, for example, as a double dovetail or dumbell. When assembling the bed the individual units are joined together by sliding the plastic hinge into corresponding slots 37 in adjacent units in such a way that the adjacent units are articulatedly connected together without any gap between the units through which dirt or fluids can pass. It will be appreciated therefore that for packing and transport purposes the bed can be supplied as a number of individual housings A to E, a hinged baseboard and a compact blower and heater unit. The hinge between sections B and C may be of a different design from the hinges between other sections in order to allow for the sections to move apart (and thereby prevent the air sacs being squeezed) as the head section is raised.

Each unit is formed with an air supply header chamber 38 and an exhaust chamber 39 and the sacs are connected across a pair of supply and exhaust header chambers by bayonet air sac connectors 40 (only one is shown) extending into the header chambers. The construction of the connectors 40 and of the spigot portion on the air sacs which cooperates with them to give a quick-release connector is described in European published patent application No. 0034954. Air is supplied to header chambers 38 by a branch tube 41 which is connected at one end to tube 20 and at the other via a valve 42 to header chamber 38. Air supply to header chamber 38 is controlled by an electric motor and gear box 43 arranged to drive each valve 42. A printed circuit board 44 carries a transducer and motor control components to determine both the pressure in the header chamber 38 and to convey instructions to the motor to adjust valve 42. A microprocessor 45 is located in the foot section E of the bed and incorporates a PROM whereby the individual pressures in the air sac units can be established and maintained within predetermined limits. These pressures can be altered by a hand operated programmer unit illustrated in FIG. 12.

Air is exhausted from the exhaust chamber 39 via a compensator valve 46 whose construction is described in our British Patent Specification No. 1,601,808. Generally, a flow rate between about 35 to 45 cubic feet per minute at a pressure of about ½ p.s.i. pressure is satisfactory. Raising or lowering the head or foot section of the bed is achieved by inflating the bellows 16 or 17 (shown in FIG. 1) either by a solenoid actuated valve of the kind shown in FIG. 4 of British Patent Application No. 2,077,859 or by an air operated valve 47 which is constructed in accordance with FIGS. 3 and 4 of our British Patent Application No. 2,070,426.

The air sacs are connected to the air sac connectors such as 40 in the panel forming upper surface of the section A to E and the supply header chamber 38 and, exhausted through similar holes in exhaust chamber 39 using connectors of the kind shown in FIGS. 5 to 8 of European Published Application No. 0 034 954 and this connector system enables the air sacs to be connected or disconnected very rapidly. The air sacs 10 are normally all of the same height, typically 25 to 30 centimeters high and 76 centimeters long, but it may be desirable to provide bags of different heights, e.g. up to 46 centimeters high and to arrange these bags transversely of the bed in order to give a contoured surface when the bed is in the flat position. Also shaped bags may be employed. For example, bags of general U-shaped form may be incorporated in the central or seat section so that bed pans or similar devices may be placed within the bed.

Figure 4:
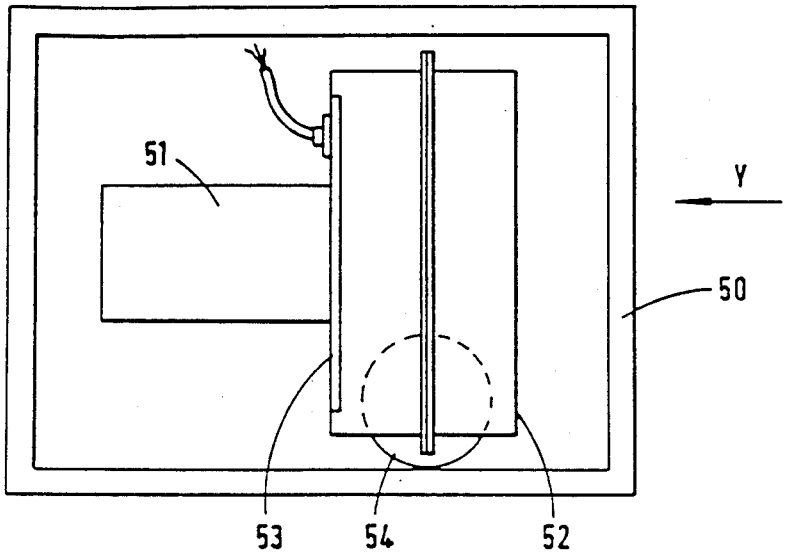
FIG. 4 is a side elevation of a blower unit partly broken away to show the interior.
Figure 4B:
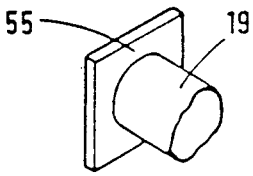
FIG. 4B is a part view of the air supply conduit of FIG. 4A.
Figure 4A:
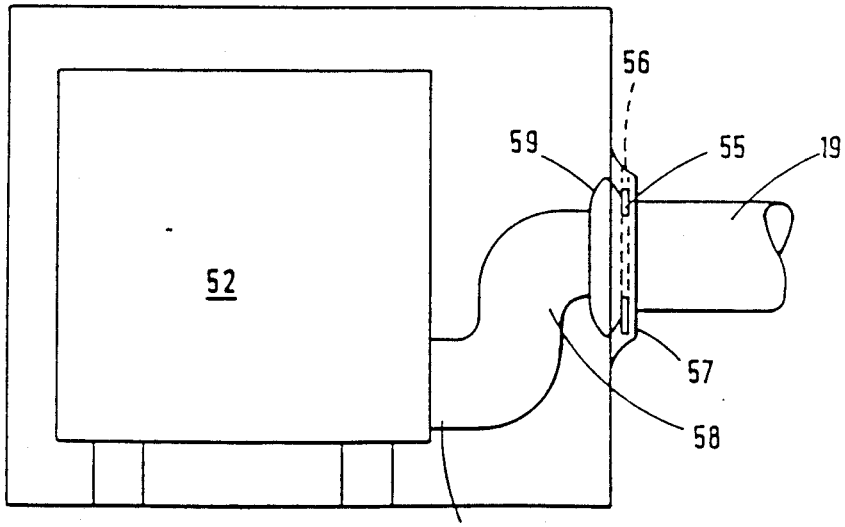
FIG. 4A is a side elevation of the blower unit seen from the direction of arrow Y in FIG. 4 showing the method of connecting the air supply conduit to the blower unit.

The construction of the blower is shown in FIG. 4. The blower housing consists of the box 50 lined with sound proofing material in which is supported an electric motor 51 driving a centrifugal blower 52. The blower may consist of one or more stages and conveniently a heater 53 is attached to the end plate or diaphragm of the blower or to one or more of the stator diaphragms. It is convenient to attach the heater element to the end diaphragm as shown at 53 since this facilitates wiring of the heater element. The heater may consist of a mat of silicone rubber in which the heater elements are bonded. Air is drawn into the blower casing through a filter (not shown). Air is supplied by the blower from outlet tube 54 and the arrangement for connecting the blower to the supply conduit 19 to the bed is shown in FIG. 4A. The blower end of conduit 19 is connected in airtight manner to a flange 55 (best seen in FIG. 4B), which is arranged to slide in a slot 56 formed in a projecting boss 57 attached to the outer wall of the blower housing. Air is fed to the conduit 19 via a tube 58 and an airtight seal is achieved by a flexible sleeve 59. When air passes through tube 58 the sleeve 59 which is lozenge-shaped in section and is formed from a flexible rubberised material, is inflated and its end face is pressed by air pressure onto the rear face of flange 55. Because of the low pressure involved, this is sufficient to provide a satisfactory seal. Thus when it is desired to disconnect the bed rapidly from the source of air, e.g. in an emergency such as when the patient suffers cardiac arrest the flange 55 is simply slid out of slot 56 and this immediately disconnects the air supply.

Figure 7:
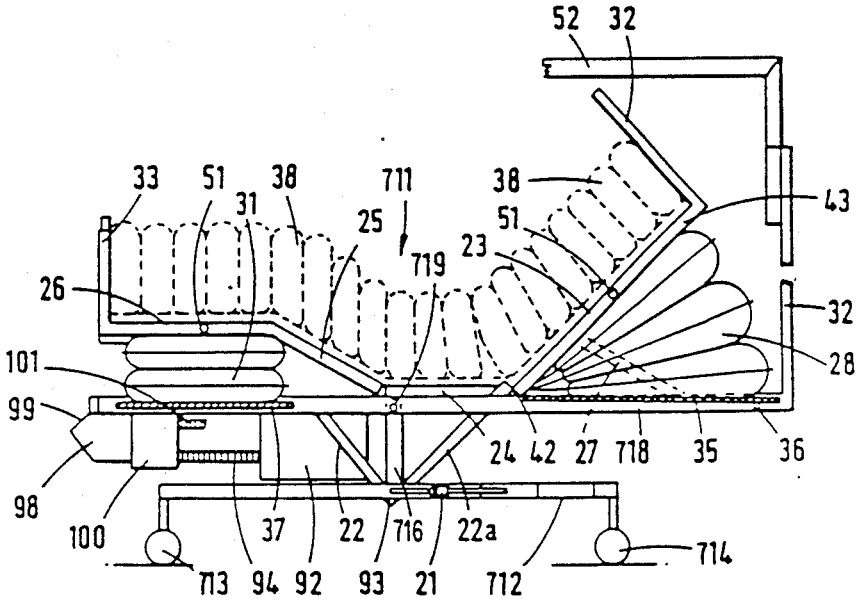
FIG. 7 is a diagrammatic side elevation of a bed similar to that described in our British Patent No. 1,474,018.

Referring now particularly to FIGS. 7 to 11, these figures show a bed whose construction is generally as described in our prior patent No. 1,474,018, and like reference numerals used in FIG. 7 other than those specifically mentioned below refer to the same parts as indicated by the same reference numerals in our above prior patent. The superstructure of the bed is supported on an attitude frame 718 which is mounted on a trolley frame 712 having castors 713 and 714. Conveniently, the trolley frame 712 includes a pair of struts 716 on which the attitude frame 718 is pivotably connected at axis 719. Struts 22 and **22*a* are connected to the attitude frame 718 at their upper ends and to each other at their lower ends by a transverse bar 93. A motorised actuator, shown diagrammatically at 21, acts between the transverse bar 93 and the trolley frame 712 to pivot the attitude frame 718 around the axis 719. Sacs 38 provide a patient support surface 711**.

Mounted beneath the attitude frame 18 is a pump unit 92 whose construction may be generally as described above. A centrifugal blower is preferred. Blower unit 92 is mounted beneath attitude frame 718 via anti-vibration rubber dampers (not shown). The blower may be as shown in FIGS. 4 and 4A with the axis of the motor and blower vertically inclined. The air output from blower unit 92 is conducted via a conduit 94 to a box 100 which is mounted beneath the attitude frame 718 and which constitutes a distribution chamber. The box 100 contains a heating element. Connected to the box 100 or integrally formed therewith is a housing 98 which contains heater controls and pressure gauges including a thermostat pressure measuring valve and devices for detecting any excess temperature developed within the bed. The housing 98 includes a front panel 99 on which temperature indicators, pressure indicator dials **99*a*, switches and other controls are mounted. A partial view of the control panel 99 is shown in FIG. 9**.

Figure 8:
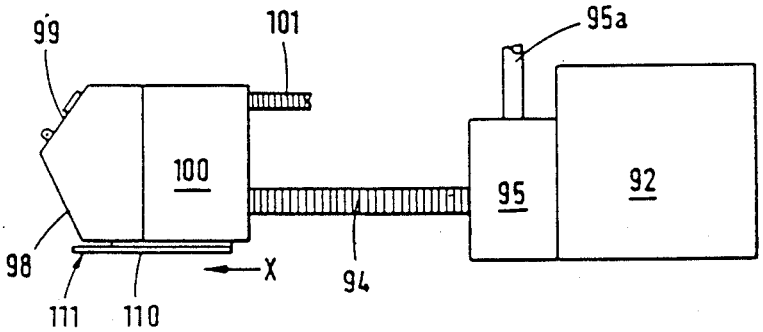
FIG. 8 is a schematic view of the blower and control box assembly of the bed shown in FIG. 7.

Referring to FIG. 8, this shows a schematic view of the air supply arrangement for the bed. Air produced by the air blower housed in blower cabinet 92 passes into a housing 95 and then via conduit 94 into heater box 100. Housing 95 also has an outlet conduit **95*a* for supplying air at blower pressure via electrically controlled valves (not shown) to head and foot bellows 28 and 31** respectively.

Figure 9:
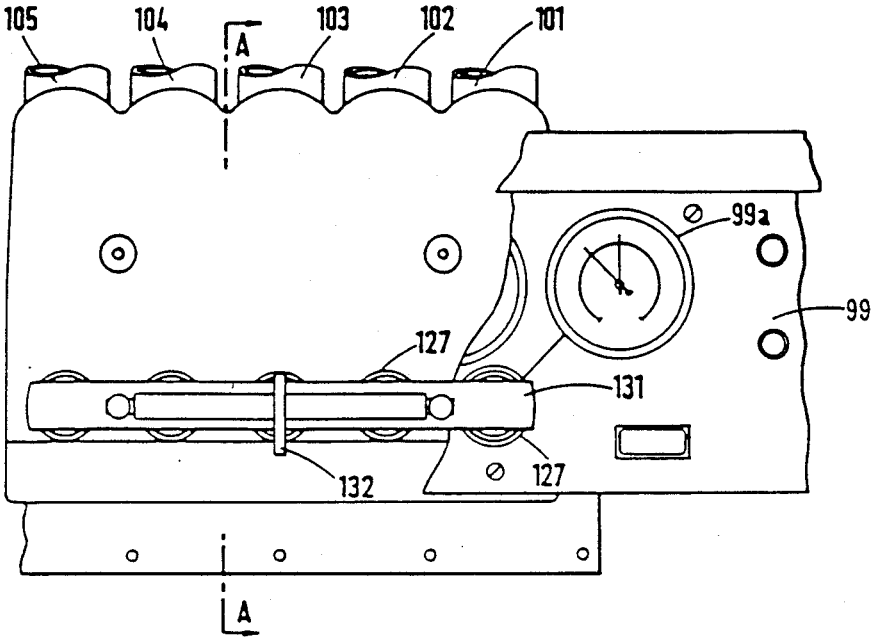
FIG. 9 is a view partially broken away of the control box.

Air supplied via conduit 94 to box 100 is heated to a thermostatically controlled temperature and passes via individually controlled pressure regulating valves to outlet conduits 101 to 105 (see FIG. 9). Each of these outlet conduits 101 to 105 supplies air at individually regulated pressure to one of the five sections of the bed via header chambers mounted within sub-frames 23, 24, 25 and 26 of the bed. Mounted beneath the box 100 is an air dump valve 110 which consists of a plate slidably mounted in guides so that pulling the handle 111 in the direction of the arrow X exposes a large opening in the base of the chamber 100. This hole is normally covered by a flap valve manufactured from flexible material, so that in normal condition, the pressure within the chamber 100 seals the flap valve over the edges of the hole. On removing the supporting plate by pulling handle 111, the flap valve is pushed outwardly and exposes the hole. The effect of this is to cause the air to exhaust from chamber 100 and the inflated air sacs 38 to deflate partly by air passing out through their inlet valves (to be described later) and partly though escape of air through the exhaust valves in the exhaust header chambers. The handle 111 would be operated in the case where the patient suffered cardiac arrest. In such a case, immediate emergency treatment would be to supply cardiac massage to the patient for which a hard flat surface is desirable. This is achieved rapidly by shutting off the blower motor and pulling the handle 111 to rapidly exhaust air from the sacs.

Air would not normally exhaust from the bellows 28, 31 in such circumstances since air is retained by the electrically operated supply and exhaust valves to these bellows. The bed would therefore preferably include a proximity switch mounted beneath the chamber 100 so as to be actuated by contact with handle 111 when it is operated. Thus, on pulling the handle 111 a signal would be transmitted to the control valves for the bellows, the effect of which would be to open the bellows exhaust valves and allow air to escape from the bellows. As an alternative to a sliding plate, the clamp valve may be a plate which is attached to an arm so that it can be pivoted away from a corresponding hole in the base or wall of the distribution chamber. The plate may be spring-loaded into contact with the rim of the hole.

Preferably the air sacs (or the upper surface thereof) is made from a microporous fabric which is nonpermable to air but is permeable to water vapour. One such material is a microporous polyurethane-coated nylon manufactured by Carrington Performance Fabrics. Another is the polytetrafluoroethylene coated fabric available under the trade mark 'Gortex'.

It is also within the scope of the present invention to provide a position sensitive electrical switch (such as a mercury switch) which does detect when the attitude frame 18 is not in its normal horizontal position. Preferably, this switch would also be activated on pulling the emergency handle 111 to send a signal to the actuator 21 to cause the bed to be returned quickly from whatever attitude it was in at the time to the horizontal position. Suitable relays and interlocks would be provided to prevent these switches operating except in a desired sequence and in an emergency situation.

A further refinement which is advantageous in the normal nursing of patients on beds in accordance with the invention is to provide a manually operated valve connected to the header chamber in the seat section of the bed. This may consist of a short plastic pipe with a manually operated valve extending therefrom. A simple vane valve may be suitable. The plastic pipe is a part of the air supply feed to the group of sacs in the seat section. Thus, the effect of closing the valve is to shut off the supply of air to the seat section, thereby allowing the sacs in this region to deflate or partially deflate by exhausting through the exhaust header chamber. Thus, a nurse may, by operating this valve, deflate the air sacs in this region for introducing a bed pan beneath the patient, or changing the sacs in this region. On turning the manual valve to its closed position, the sacs will reinflate to their previously predetermined pressure.

Figure 11:
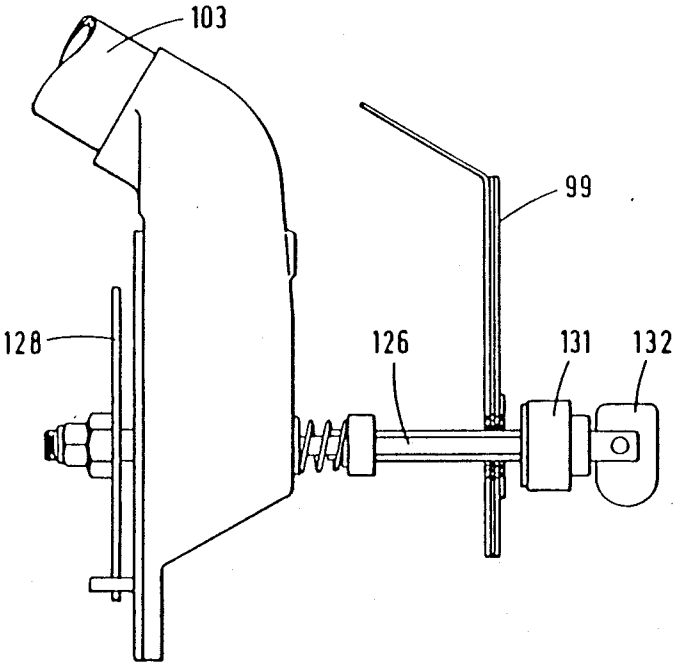
FIG. 11 is a section taken along the line A-A in FIG. 9.
Figure 10:
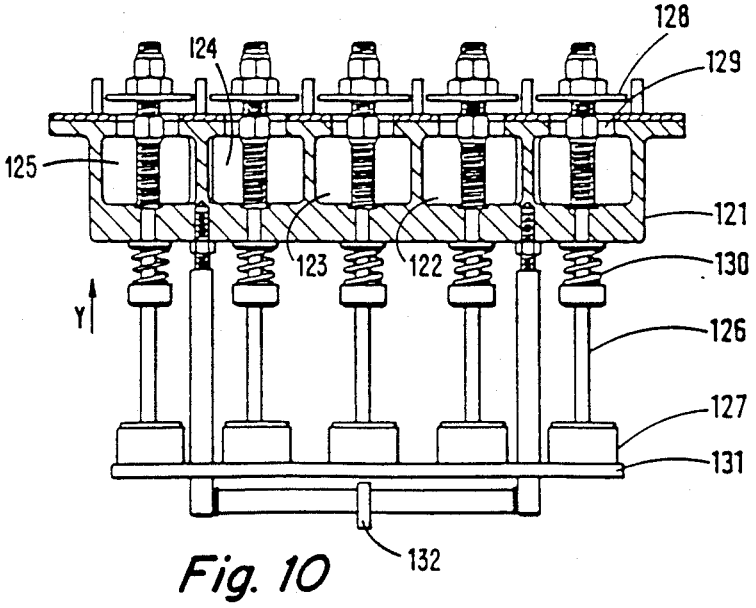
FIG. 10 is a view showing the operating mechanism of the valves within control box.

Referring to FIGS. 9 to 11, these show the controls for the individual pressure regulating valves for each of the five groups of sacs on the bed shown in FIGS. 7 and 8. The feed of air from the blower supply via conduit 94 to each sac supply conduit 101 to 105 is controlled by individual valves 121 to 125. Each of these valves includes a rotatable valve stem 126 which when rotated provide by means of knob 127 in a clockwise direction will lift plate 128 off valve port 129 by an amount dependent on the degree by which it is turned. The amount by which each valve plate is raised from its valve seat will predetermine the pressure of air within the group of sacs which it feeds. The individual valves may also be opened by depressing valve stem 126 in the direction of the arrow Y against the effect of spring 130. The valve stems 126 can be depressed in the direction of arrow Y simultaneously by pressing on plate 131. This downward movement can be effected by rotating cam 132. The effect of this movement is to open all of the valves 121 to 125 to their maximum extent simultaneously and results in application of maximum air pressure (blower pressure) to all groups of sacs. The instantaneous inflation of all air sacs to maximum pressure enables, for example, a nurse to turn the patient more easily or to move the patient in the bed by sliding him on the firm surface of the sacs inflated at maximum pressure. After all the sacs have been inflated to maximum pressure (typically 25 to 30 mm of mercury) the cam 132 can be returned to its nonoperative position which allows the plate 131 to be lifted off the control knobs 127 and the valves will then return to their individual regulated preset pressure.

Figure 11B:
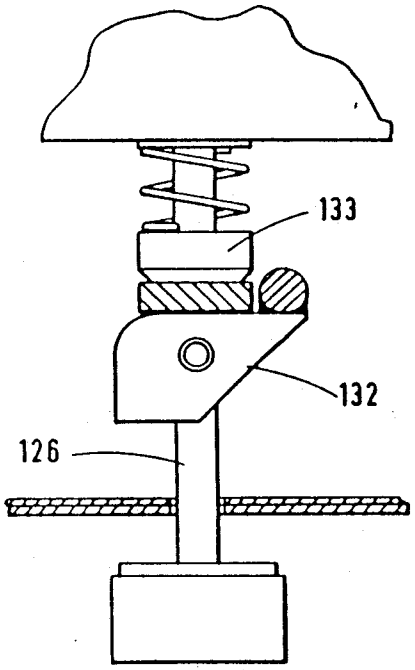
FIGS. 11A and 11B show modifications of the control mechanism of the valves shown in FIGS. 10 and 11.
Figure 11A:
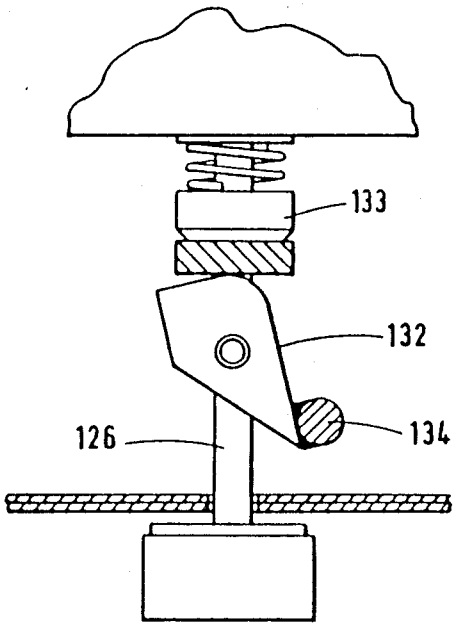

It will be appreciated that instead of mounting the cam 132 so that it presses on the tops of the operating knobs 127, a neater arrangement can be provided by arranging the plate 131 so that it presses on the bushes 133 when the cam is operated. In this way, the valve stems 126 may project through the front panel of the control housing. The cam 132 is then operated by pulling a rod (not shown) which extends through the panel of the control housing and is linked to a rod 134 attached to the cam. The operation is shown in FIGS. 11A (valve closed position) and 11 (valve open position).

It will also be appreciated that the embodiment shown in FIGS. 7 to 11, may be modified by dispensing with a distribution chamber and controls mounted on the supporting frame of the bed and instead providing equivalent functions in the bed sections 23, 24, 25 and 26. Thus, these sections of the bed may be constructed as shown in FIGS. 1 to 6 and the outlet conduit 94 from the blower 92 connected directly to a tubular member (similar to tube 20 in FIG. 1) in the seat section 24.

The electrical supply to the beds includes a main supply to the motor and heater and a transformer to power the electrical services on the bed including temperature and pressure control. The electrical circuit also includes a sensor to sense the temperature of the air supply to the bed, the temperature within the bed and the blower motor temperature. These measurements are separately monitored and the supply automatically shut off in the event of excess temperature in any of these areas.

Figure 12:
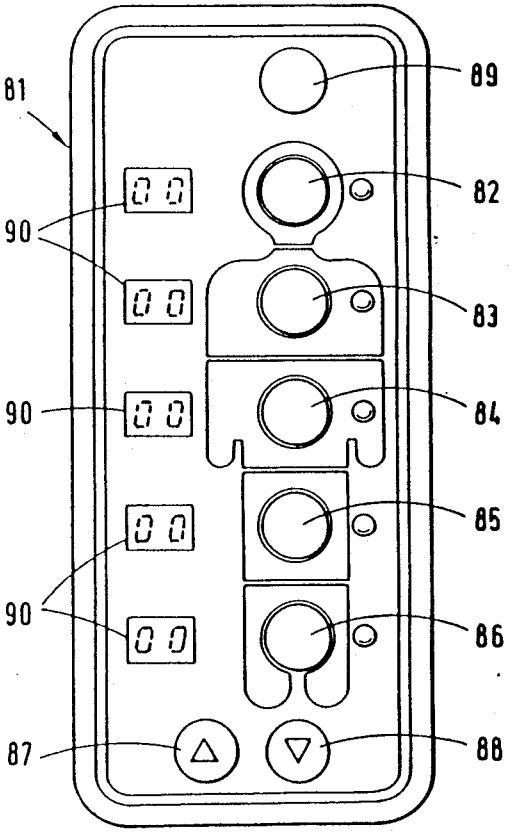
FIG. 12 is a plan view of a hand-operated programmer unit for setting the pressures in the group of air sacs in support appliances in accordance with the invention.

FIG. 12 shows the remote hand-operated programmer unit 81 for setting the pressures in the individual groups of sacs in beds constructed in accordance with the invention. The unit 81 is connected to the microprocessor 45. The unit has a series of buttons 82 to 86 for selecting the groups of sacs where pressure is to be changed, and two buttons 87 and 88 for raising or lowering the air pressure. A further control button 89 enables the pressure in all groups to be altered simultaneously. Digital gauges 90 give constant displays of the pressure in each group of sacs. The microprocessor unit is programmed to monitor the pressure in each group of air sacs (via transducers on printed circuit board 44) and to maintain the pressure which has been set for each group.

We claim:

1. A patient support appliance comprising:

(a) a base providing a substantially flat, obstruction free surface;

(b) a plurality of inflatable air sacs mounted on the base and extending transversely thereof so as to provide when inflated, a surface for supporting a person thereon;

(c) said base being divided into sections lengthwise of the appliance, some of said sections being mutually articulated, and said air sacs being arranged in groups corresponding to said sections;

(d) an air blower for supplying air to said sacs which blower is mounted beneath said base;

(e) a main air supply conduit for feeding air from the blower to a distribution chamber and individual air supply tubes, each leading from the distribution chamber to one of said groups of sacs;

(f) individual pressure regulating valves to regulate individually the pressure of air in said air supply tubes so that the pressure in each group of sacs can be regulated independently of the others;

(g) means for switching said valves between a first configuration in which they are simultaneously in their substantially fully open position and a second configuration in which they are independently controllable to different openings; and, (h) means for exhausting air rapidly from the distribution chamber whereby the sacs may be quickly deflated.

2. An appliance according to claim 1 wherein the distribution chamber comprises a housing suspended from said base adjacent one end of the appliance.

3. An appliance according to claim 1 wherein the means for exhausting air comprises an opening in said chamber which is normally covered by a plate, the plate being movable to expose the opening and exhaust air from the chamber.

4. An appliance according to claim 1 wherein air is arranged to enter said sacs at points therein and exit at other points, thereby providing a flow of air through said sacs.

5. An appliance according to claim 1 wherein the base is pivotably mounted on a trolley frame about a transverse axis which is located in the central region of the appliance and the chamber and blower are both suspended from said base, the blower being located close to said transverse axis and the chamber located in the region of one end of the bed.

6. An appliance according to claim 1 wherein the presure regulating valves are mounted side by side and each comprises a valve stem carrying a valve plate, which is movable towards and away from a valve seat to vary the flow of air through the valve.

7. An appliance according to claim 6 which includes means for operating the valve stems of the regulating valves simultaneously into the fully open configuration of said valves.

8. A patient support appliance comprising:

(a) a base providing a substantially flat, obstruction free surface;

(b) a plurality of inflatable air sacs mounted on the base and extending transversely of thereof so as to provide when inflated, a surface for supporting a person thereon;

(c) said base being divided into sections lengthwise of the appliance, some of said sections being mutually articulated and said air sacs being arranged in groups corresponding to said sections;

(d) an air blower for supplying air to said sacs which blower is mounted beneath said base;

(e) a main air supply conduit for distributiong air from said blower to said sections and individual air supply tubes leading from the main air supply conduit to one of said groups of sacs;

(f) pressure regulating valves located in each section to regulate individually the pressure supplied to the sacs in each section;

(g) means for switching said valves between a first configuration in which they are simultaneously in their substantially fully open position and a second configuration in which they are independently controllable to different openings; and, (h) means for exhausting air rapidly from the main air supply conduit whereby the sacs may be quickly deflated.

9. An appliance according to claim 8 wherein said main supply conduit comprises a tubular air supply member having a generally flattened oval cross-section.

10. An appliance according to claim 9 in which the tubular air supply member comprises a plurality of corresponding tubular portions, which are joined by flexible connecting portions between adjacent articulated sections.

11. An appliance according to claim 10 wherein each bed section comprises a pair of laterally spaced longitudinally extending members joined by a panel to form a flat, obstruction free surface, one of said tubular portions of said tubular air supply member being located beneath said panel and between said longitudinal members, the end or ends of each said tubular portion being connected to a tubular portion in an adjacent section via a flexible connecting portion.

12. An appliance according to claim 11, in which the longitudinal members are hollow and form, respectively, supply and exhaust headers, for supplying air to and exhausting air from the sacs, the supply headers being connected via an individual air supply tube and a pressure regulating valve to said tubular air supply member and the exhaust means for discharging air to atmosphere.

13. An appliance according to claim 12 in which the exhaust means comprises a valve for controlling the discharge of air to atmosphere and is adapted to maintain an air flow through the sacs which is greater than a predetermined minimum.

14. An appliance according to claim 12 in which each air sac is releasably attached to said base and connected to the supply and exhaust headers by releasable connectors.

15. An appliance according to claim 12 wherein air pressure in each group of sacs is sensed by a transducer located in each bed section, the output from the transducers being monitored by a microprocessor which is programmable to set and maintain the pressure in each group of sacs.

16. A patient support appliance comprising:

(a) a base providing a substantially flat, obstruction free surface;

(b) a plurality of inflatable air sacs mounted on the base and extending transversely thereof so as to provide, when inflated, a surface for supporting a person thereon;

(c) said base being divided into sections lengthwise of the appliance, some of said sections being mutually articulated, and said air sacs being arranged in groups corresponding to said sections;

(d) an air blower for supplying air to said sacs which blower is mounted beneath said base;

(e) a main air supply conduit for feeding air from the blower to a distribution chamber and individual air supply tubes, each leading from the distribution chamber to one of said groups of sacs;

(f) individual pressure regulating valves to regulate individually the pressure of air in said air supply tubes so that the pressure in each group of sacs can be regulated independently of the others;

(g) means for switching said valves between a first configuration in which they are simultaneously in their substantially fully open position and a second configuration in which they are independently controlable to different openings; and, (h) air dumping means for exhausting air rapidly from the sacs in an emergency, said air dumping means comprising an opening in said chamber which is normally covered by a plate, said plate being movable to expose the opening and dump air from the chamber.

* * * * *